US010981718B2

(12) United States Patent
Polloni et al.

(10) Patent No.: US 10,981,718 B2
(45) Date of Patent: Apr. 20, 2021

(54) PACKET OF SMOKE ARTICLES

(71) Applicant: G.D S.p.A., Bologna (IT)

(72) Inventors: Roberto Polloni, Modigliana (IT); Alver Tacchi, Bologna (IT); Lorena D'Alfonso, Bologna (IT); Giuseppe Marchitto, Lugo (IT); Marcello Tenaglia, Bologna (IT); Stefano Negrini, Calderara di Reno (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 16/260,824

(22) Filed: Jan. 29, 2019

(65) Prior Publication Data

US 2019/0152687 A1 May 23, 2019

Related U.S. Application Data

(62) Division of application No. 15/502,308, filed as application No. PCT/IB2015/056147 on Aug. 12, 2015, now abandoned.

(30) Foreign Application Priority Data

Aug. 12, 2014 (IT) ..... BO2014A000461

(51) Int. Cl.
*B65D 85/10* (2006.01)
*A24F 15/12* (2006.01)
(Continued)

(52) U.S. Cl.
CPC ..... *B65D 85/1045* (2013.01); *A24F 15/12* (2013.01); *B65D 25/04* (2013.01); *B65D 65/02* (2013.01)

(58) Field of Classification Search
CPC .... B65D 85/08; B65D 85/10; B65D 85/1009; B65D 85/1018; B65D 85/1027;
(Continued)

(56) References Cited

U.S. PATENT DOCUMENTS 1,164,782 A * 12/1915 Cohen ..... B65D 85/1072 206/256
1,700,432 A * 1/1929 Cahill ..... B65D 5/48046 229/120.35
(Continued)

FOREIGN PATENT DOCUMENTS

DE 2327294 A1 1/1975
DE 2331062 A1 1/1975
(Continued)

OTHER PUBLICATIONS

DE_2327294_Translation.
(Continued)

*Primary Examiner* — Allan D Stevens
(74) *Attorney, Agent, or Firm* — Whitmyer IP Group LLC

(57) ABSTRACT

Packet of smoke articles, including: a container, which has a parallelepiped shape and has a front wall, a rear wall, a bottom wall and two lateral walls; a parallelepiped-shape inner wrapper that wraps a group of smoke articles, which is housed inside the container and has a front wall, a rear wall, a top wall, a bottom wall and two lateral walls; and a separating element, which is arranged inside the inner wrapper and divides the inner volume of the inner wrapper so as to form several partitions of the group of smoke articles.

12 Claims, 12 Drawing Sheets

(51) Int. Cl.
*B65D 25/04* (2006.01)
*B65D 65/02* (2006.01)

(58) Field of Classification Search
CPC ..... B65D 85/1036; B65D 85/1054; B65D 85/1063; B65D 85/1072; B65D 85/109; B65D 85/1081; B65D 85/1045; B65D 5/48048; B65D 5/48042; B65D 5/48046; B65D 5/48026; B65D 5/48024; B65D 77/003; B65D 65/24; B65D 25/04; A24F 15/20; A24F 15/02; A24F 15/00
USPC ..... 206/256, 258, 257
See application file for complete search history.

(56) References Cited

U.S. PATENT DOCUMENTS

| | | | | | |
|---|---|---|---|---|---|
| 2,104,828 | A * | 1/1938 | Brinnon | B65D 5/48048 | 206/278 |
| 3,599,520 | A | 8/1971 | Wood | | |
| 3,758,020 | A * | 9/1973 | Childs | B65D 5/38 | 206/422 |
| 6,216,861 | B1 | 4/2001 | James et al. | | |
| 7,377,384 | B2 * | 5/2008 | Mitten | 206/256 | |
| 2010/0065449 | A1 * | 3/2010 | Morgan | B65D 5/38 | 206/268 |
| 2011/0147443 | A1 * | 6/2011 | Igo | B65D 75/5838 | 229/117.31 |
| 2020/0331654 | A1 * | 10/2020 | Reid | A47G 7/044 | |

FOREIGN PATENT DOCUMENTS

| | | | | |
|---|---|---|---|---|
| EP | 0370265 | A1 | | 5/1990 |
| GB | 588741 | A | | 6/1947 |
| GB | 1473675 | A | * | 5/1977 |
| JP | S5025800 | A | | 3/1975 |
| JP | 2006333713 | A | | 12/2006 |

OTHER PUBLICATIONS

DE_2331062_Translation.
DE2327294_annotated_fig.1.
International Search Report & Written Opinion of the International Searching Authority Application No. PCT/IB2015/056147 Completed: Oct. 16, 2015; dated Oct. 23, 2015 11 Pages.
U.S. Office Action U.S. Appl. No. 15/502,308 dated Feb. 13, 2018 8 pages.
U.S. Office Action U.S. Appl. No. 15/502,308 dated Oct. 29, 2018 11 Pages.
U.S. Office Action U.S. Appl. No. 15/502,308 dated Dec. 27, 2017 14 pages.
Japanese Office Action (Translation) Application No. 2017-507149 Completed: Apr. 5, 2019 6 Pages.

* cited by examiner

PACKET OF SMOKE ARTICLES

CROSS-REFERENCE TO RELATED APPLICATIONS

The present application is a division of U.S. patent application Ser. No. 15/502,308, filed on Feb. 7, 2017, which in turn is a national phase of PCT International Application No. PCT/IB2015/056147 filed Aug. 12, 2015. PCT/162015/056147 claims priority to IT Application No. BO2014A000461 filed Aug. 12, 2014. The entire contents of these applications are incorporated herein by reference.

TECHNICAL FIELD

The present invention relates to a packet of smoke articles configured for housing a group of smoke articles of reduced dimension, i.e. a group of smoke articles having a longitudinal dimension that is less than or the same as a greater cross section of the packet. The present invention is applied to a rigid packet of cigarettes, to which the following description will refer explicitly without thereby losing general relevance.

BACKGROUND

In packets of cigarettes configured for housing a group of cigarettes of reduced longitudinal dimension it may happen that, when only a few cigarettes are present, these cigarettes fall in overturned positions which make the cigarettes difficult to extract.

In order to overcome this drawback, packets have been developed that are known as "twin packets" or "double pocket packets". A twin packet consists of two internal half packets that are provided with respective metal foil inner wrappers, are coupled with a single inner frame, a central portion of which is folded like a book and is interposed between the half packets, and are arranged alongside the same outer container. A drawback of twin packets is that in order to be made, the twin packets require machines that are particularly complex, costly and bulky and are difficult to maintain and repair. In fact, machines for making twin packets can use two different wrapping methods, both of which have drawbacks.

A first operating method provides for the simultaneous production of two sequences of groups of cigarettes and the advancement of these two sequences along two first parallel wrapping lines along which, around each group of cigarettes, a metal foil enclosure is formed, i.e. the inner wrapper, to form a respective half packet. Each first wrapping line then supplies a sequence of respective half packets to an intermediate transferring station, and each pair of half packets that reaches the transferring station defines a group of half packets. With the group of half packets an inner frame of folded cardboard is associated and subsequently the group of half packets is transferred to a second wrapping line, along which, around each group of half packets, an outer enclosure is formed, i.e. the container of the packet. This first method has the drawback of doubling the first wrapping line and of there being an intermediate transferring station.

A second operating method provides for the production of a single sequence of groups of cigarettes and the advancement of this sequence along a first wrapping line along which, around each group of cigarettes, a metal foil enclosure is formed, i.e. the inner wrapper, to form a half packet. The first wrapping line then supplies a sequence of half packets to an intermediate transferring station, which removes one pair of half packets at a time from the first wrapping line to define a group of half packets. With the group of half packets an inner frame of folded cardboard is associated and subsequently the group of half packets is transferred to a second wrapping line, along which, around each group of half packets, an outer enclosure is formed, i.e. the container of the packet. This second method has the drawback of halving production speed as two half packets in succession have to be formed to produce just one complete packet leaving the machine.

Furthermore, there are known packets of the type disclosed in DE2327294A1 and DE2331062A1. In particular, the packets described in DE2327294A1 and DE2331062A1 comprises an outer container and an inner wrapper, wrapping a group of smoke articles, which is housed inside the outer container. A divider is provided inside the inner wrapper, which divides the inner volume of the inner wrapper so as to form two compartments.

SUMMARY

The aim of the present invention is to provide a packet of smoke articles which is free of the drawbacks disclosed above and is at the same time easy and cheap to make.

According to the present invention a packet of smoke articles is provided as claimed in the appended claims.

BRIEF DESCRIPTION OF THE DRAWINGS

The present invention will now be disclosed with reference to the attached drawings that illustrate some embodiments thereof by way of non-limiting to example, in which.

DETAILED DESCRIPTION

In this description, similar elements that are common to the illustrated embodiments are indicated by the same reference.

In FIGS. 1 to 6, with number 1 there is indicated overall a rigid packet of cigarettes extending along a longitudinal axis A parallel to a longitudinal axis of prevalent extent of the cigarettes.

The packet 1 comprises a parallelepiped-shape container 2 and an inner wrapper 3 that wraps a group of cigarettes and is housed inside the container 2.

Figure 2:
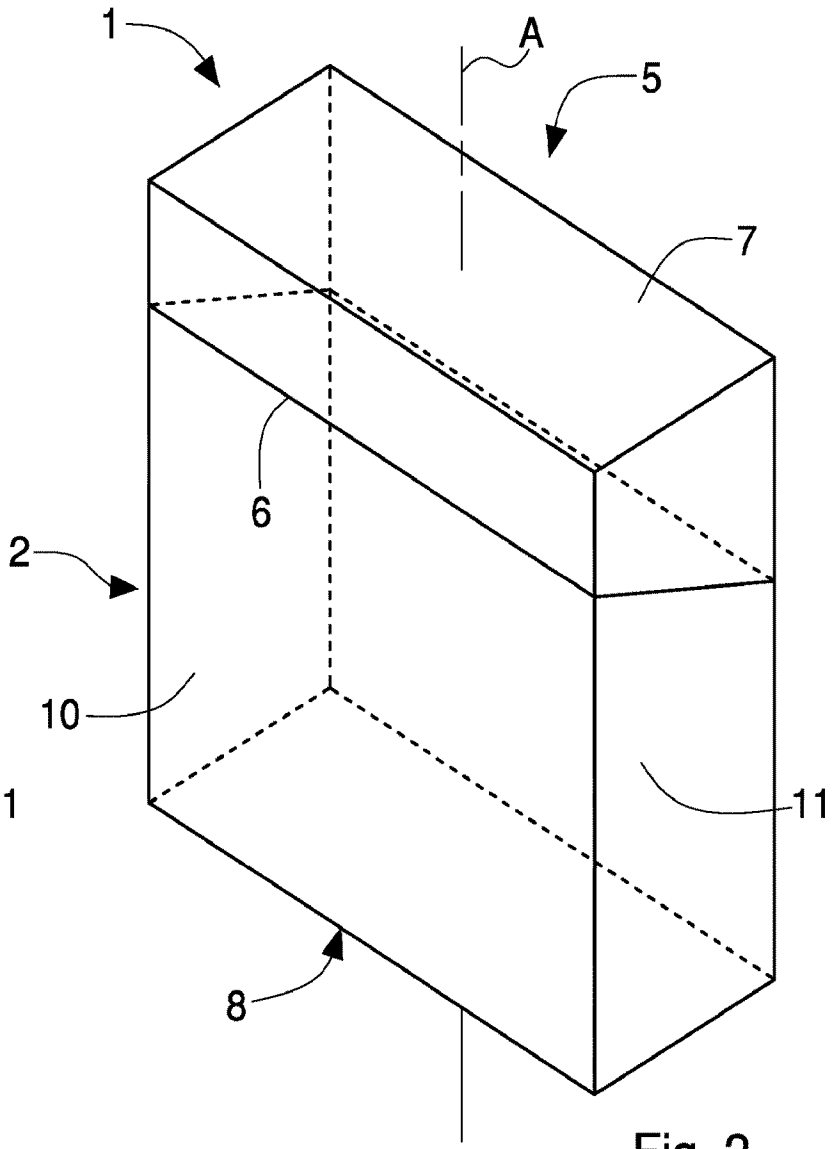
FIG. 2 is a rear schematic perspective view of the packet of cigarettes of FIG. 1 in an open configuration.
Figure 1:
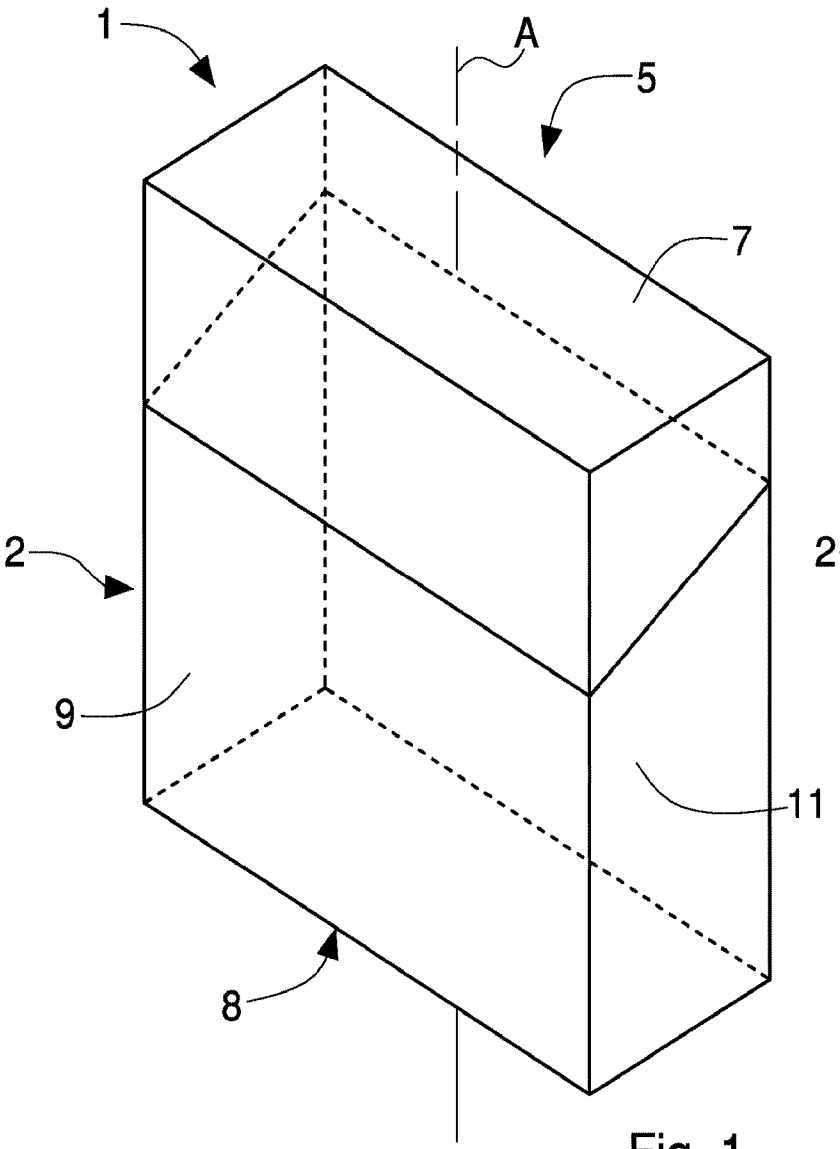
FIG. 1 is a front schematic perspective view of a rigid packet of cigarettes in a closed configuration made according to the present invention.
Figure 4:
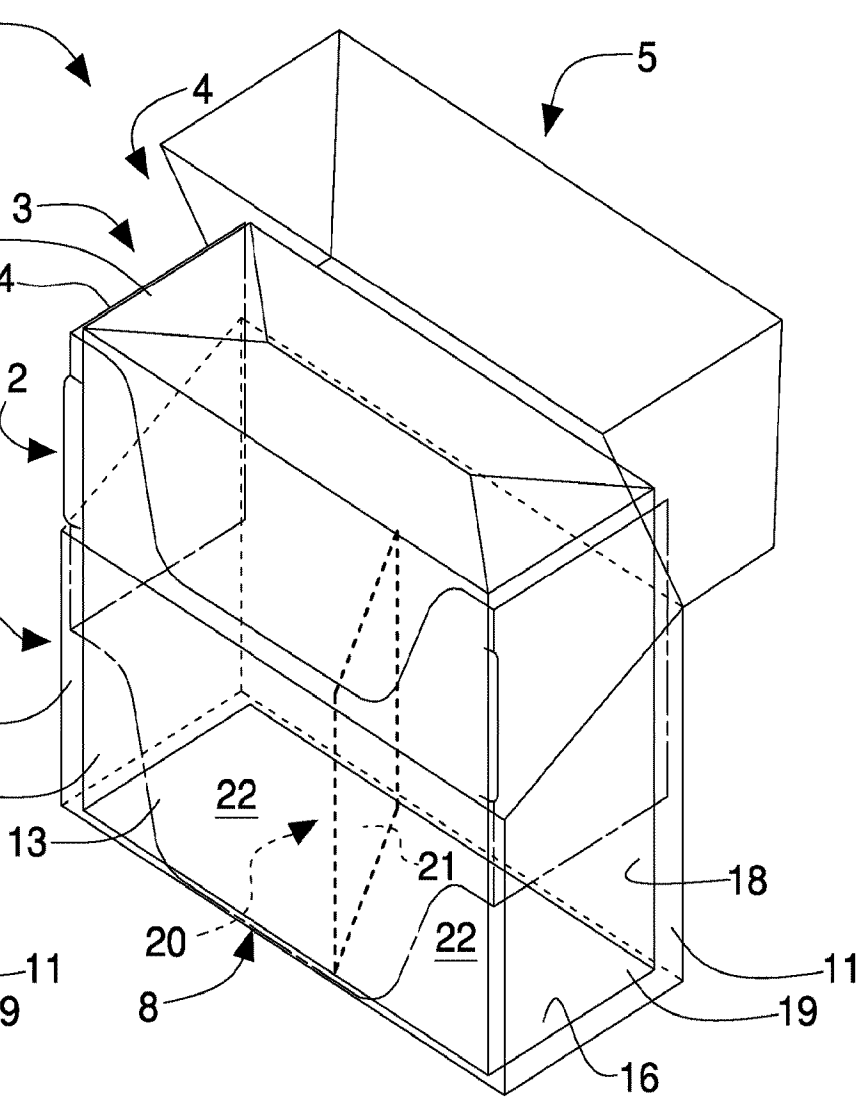
FIG. 4 is a front schematic perspective view of the packet of cigarettes of FIG. 1 in an open configuration and with the group of cigarettes removed from the inner wrapper.
Figure 3:
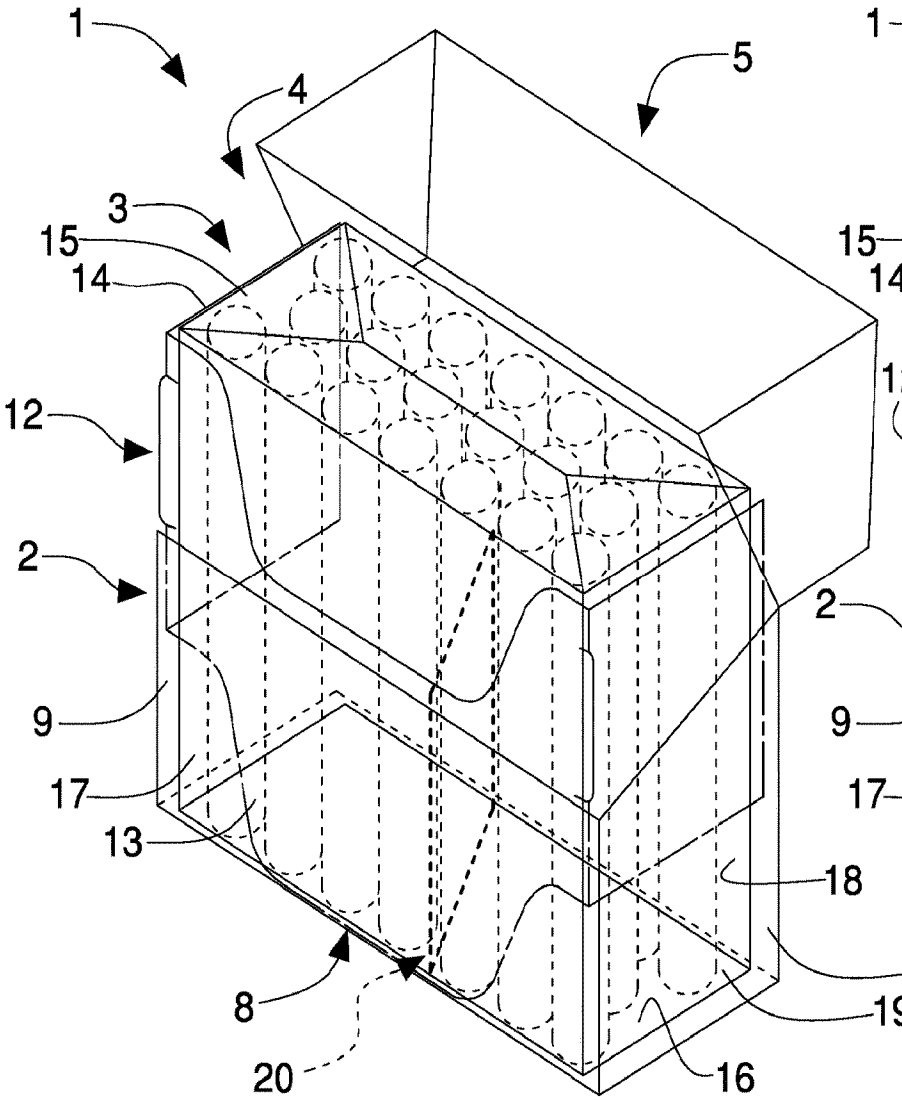
FIG. 3 is a front schematic perspective view of the packet of cigarettes of FIG. 1 in an open configuration.

The container 2 has an open top end 4 and is provided with a lid 5, which is cup-shaped and is hinged to the container 2 along a hinge 6 to rotate, with respect to the container 2, between an open position, illustrated in FIGS. 3 and 4, and a closed position, illustrated in FIGS. 1 and 2, of the open top end 4.

The lid 5, when it is in the closed position, gives the container 2 a rectangular parallelepiped-shape having a top wall 7 and a bottom wall 8 that are parallel and opposite one another, a front wall 9 and a rear wall 10 that are parallel and opposite one another, and two lateral walls 11 that are parallel and opposite one another. Between the lateral walls 11 and the front wall 9 and rear wall 10 four longitudinal edges are defined, whereas between the top wall 7 and bottom walls 8 and the front wall 9, rear wall 10 and lateral walls 11 eight transverse edges are defined; in particular, between the top wall 7 and bottom wall 8 and the front wall 9 and rear wall 10 four greater transverse edges are defined, whereas between the top wall 7 and bottom wall 8 and lateral walls 11 four lesser transverse edges are defined. The length of the diagonal of the bottom wall 8 of the container 2 is greater than, or the same as, the longitudinal dimension, i.e. measured parallel to the longitudinal axis A of the packet 1, of the cigarettes constituting the group of smoke articles.

According to what is illustrated in FIGS. 3 and 4, the packet 1 further comprises an inner frame 12, which is connected (by gluing) folded as a "U" inside the container 2 for projecting partially outside the open top end 4 and engaging a corresponding inner surface of the lid 5 when the lid 5 is arranged in the aforesaid closed position. The inner frame 12 comprises a front wall 13, which is arranged in contact with the front wall 9 of the container 2, and two lateral walls 14, which are arranged on opposite sides of the front wall 13 and are arranged in contact with the lateral walls 11 of the container 2. Generally, the front wall 13 of the inner frame 12 is glued to an inner wall of the front wall 9 of the container 2 and the lateral walls 14 of the inner frame 12 are glued to inner surfaces of the corresponding lateral walls 11 of the container 2.

The inner wrapper 3 which also has a parallelepiped shape and consists of a sheet of metal foil wrapped around the group of cigarettes. The inner wrapper 3 comprises a top wall 15 and a bottom wall 16 that are parallel and opposite one another, a front wall 17 and a rear wall 18 that are parallel and opposite one another, and two lateral walls 19 that are parallel and opposite one another.

According to what is better illustrated in FIGS. 3 to 6, the packet 1 comprises a separating element 20, i.e. a divider, which is arranged inside the inner wrapper 3. The separating element 20 comprises a separating wall 21 that separates the inner volume of the inner wrapper 3 into two chambers 22, each arranged for housing a partition, i.e. a sub-group, of the group of cigarettes, in particular, the separating element 20 is formed by a single separating wall 21. In other words, the separating element 20 is positioned inside the inner wrapper 3 and divides, by the separating wall 21, the inner volume of the inner wrapper 3 into the chambers 22 which are longitudinally adjacent along the longitudinal axis A of extent of the packet 1; accordingly, the separating wall 21 separates the two chambers 22 from one another and constitutes the border between the two chambers 22. In the example shown, each chamber 22 contains a sub-group of cigarettes formed by ten cigarettes.

According to an embodiment, the separating wall 21 of the separating element 20 ends lower than the front wall 13 of the inner frame 12. In other words, the distance between a top edge of the separating wall 21 of the separating element 20 and the bottom wall 8 of the container 2 is less than the distance between a top edge of the front wall 13 of the inner frame 12 and the bottom wall 8 of the container 2. In this manner, and with reference to the base of the packet 1 defined by the bottom wall 8 of the container 2, "lower" being defined as the fact of being nearer the base, it should be noted that the separating wall 21 of the separating element 20 ends lower than the inner frame 12, consequently facilitating the extraction of the cigarettes from the inner wrapper 3 and at the same time ensuring suitable longitudinal support to the cigarettes.

Also, the separating element 20 is made as a single body, for example of cardboard, and is fixed, for example with an adhesive strip, to an inner surface of the inner wrapper 3. In particular, the separating wall 21 comprises a longitudinal edge resting on and fixed to the rear wall 18 of the inner wrapper 3.

According to a further embodiment that is not illustrated, the longitudinal edge of the separating wall 21 rests on and is fixed to the front wall 17 of the inner wrapper 3.

Figure 6:
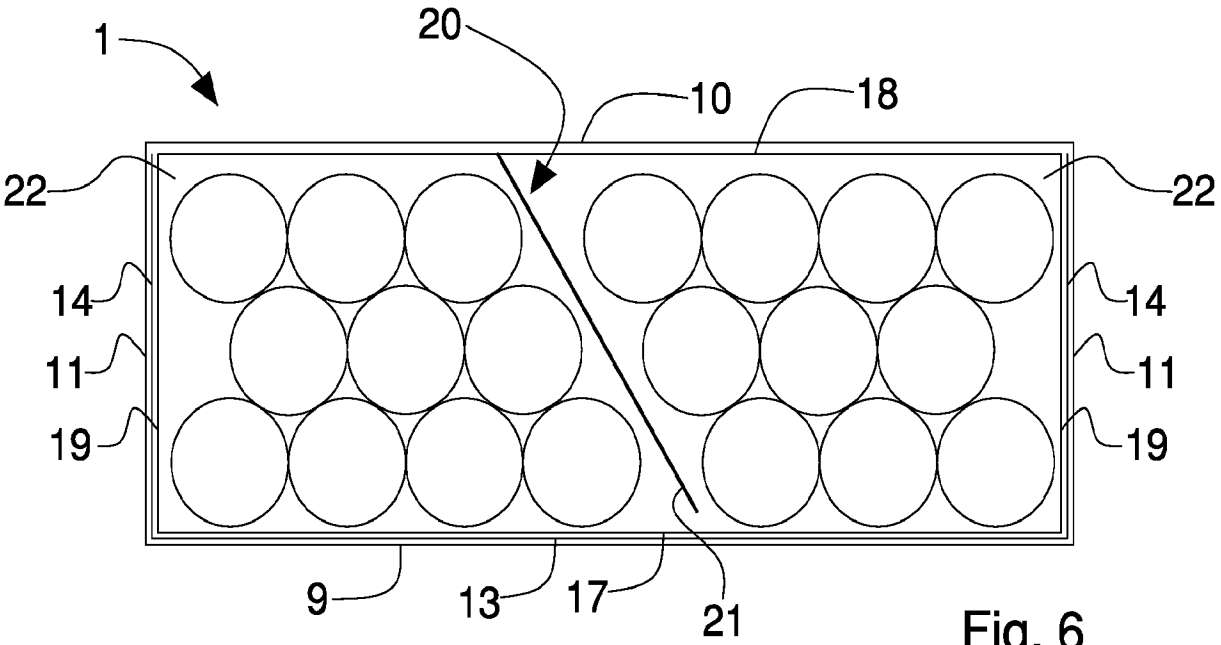
FIG. 6 is a cross section of the packet of cigarettes of FIG. 1.
Figure 5:
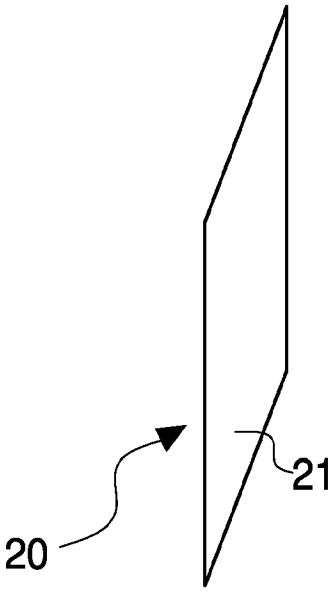
FIG. 5 is a schematic perspective view of a separating element included in the packet of cigarettes of FIG. 1.

In the embodiment illustrated in FIGS. 3, 4 and 6, the separating wall 21 extends parallel to a longitudinal axis of the cigarettes and is arranged transversely to the front wall 17 and rear wall 18 of the inner wrapper 3.

According to a further embodiment that is not illustrated, the separating wall 21 extends parallel to a longitudinal axis of the cigarettes and is arranged perpendicularly to the front wall 17 and rear wall 18 of the inner wrapper 3

Also, the separating wall 21 extends substantially over the entire distance that separates the rear wall 18 and the front wall 17 of the inner wrapper 3.

Figure 7:
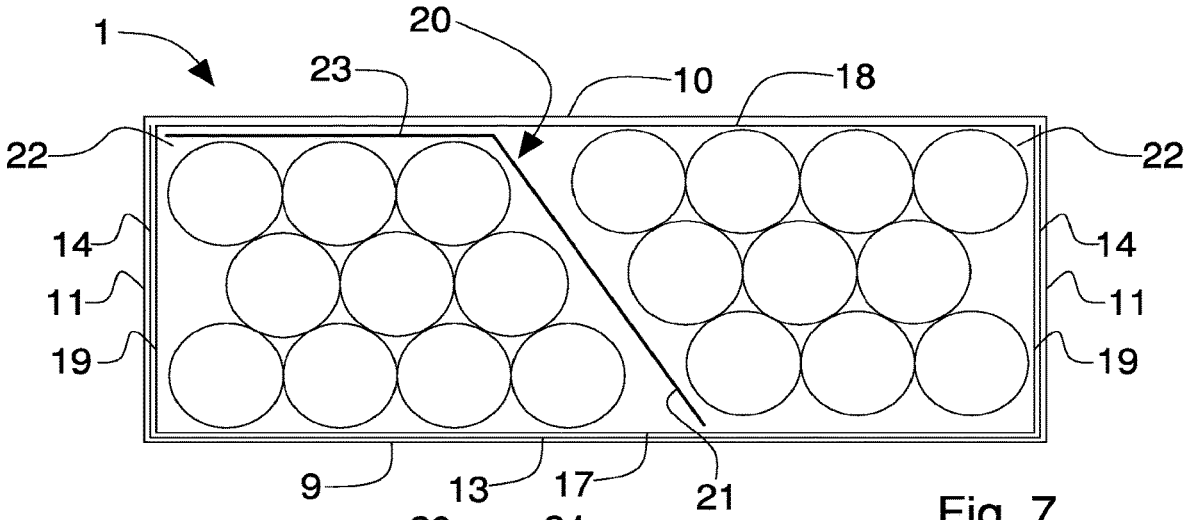
FIG. 7 is a cross section of the packet of cigarettes of FIG. 1 including a different embodiment of the separating element.

In the embodiment illustrated in FIG. 7, the separating element 20 comprises a separating wall 21 that extends parallel to a longitudinal axis of the cigarettes, is arranged transversely to the front wall 17 and rear wall 18 of the inner wrapper 3, and extends substantially over the entire distance that separates the rear wall 18 and the front wall 17 of the inner wrapper 3. According to a further embodiment that is not illustrated, the separating wall 21 extends parallel to a longitudinal axis of the cigarettes and is arranged perpendicularly to the front wall 17 and rear wall 18 of the inner wrapper 3.

The separating wall 21 separates the inner volume of the inner wrapper 3 into two chambers 22, each arranged for housing a sub-group of cigarettes formed by an identical number of cigarettes, in particular by ten cigarettes.

In the embodiment illustrated in FIG. 7, the separating element 20 further comprises a fixing wall 23 connected to the separating wall 21 by a folding line.

The fixing wall 23 rests on and is glued to the rear wall 18 of the inner wrapper 3. In this manner, the fixing wall 23 is integral with the rear wall 18 of the inner wrapper 3 and holds the separating element 20 inside the inner wrapper 3.

According to a further embodiment that is not illustrated, the fixing wall 23 rests on and is glued to the front wall 17 of the inner wrapper 3.

According to an embodiment, the separating wall 21 has a longitudinal dimension that is less than or the same as the longitudinal dimension of the fixing wall 23, the separating wall 21, ending lower than the inner frame 12.

Figure 8:
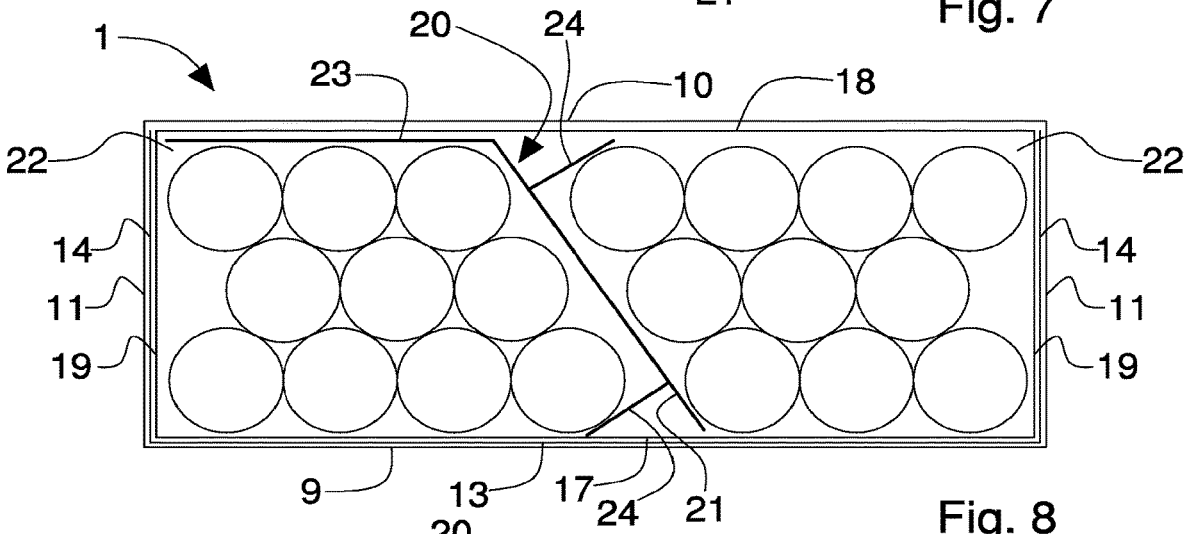
FIG. 8 is a cross section of the packet of cigarettes of FIG. 1 including another embodiment of the separating element.
Figure 9:
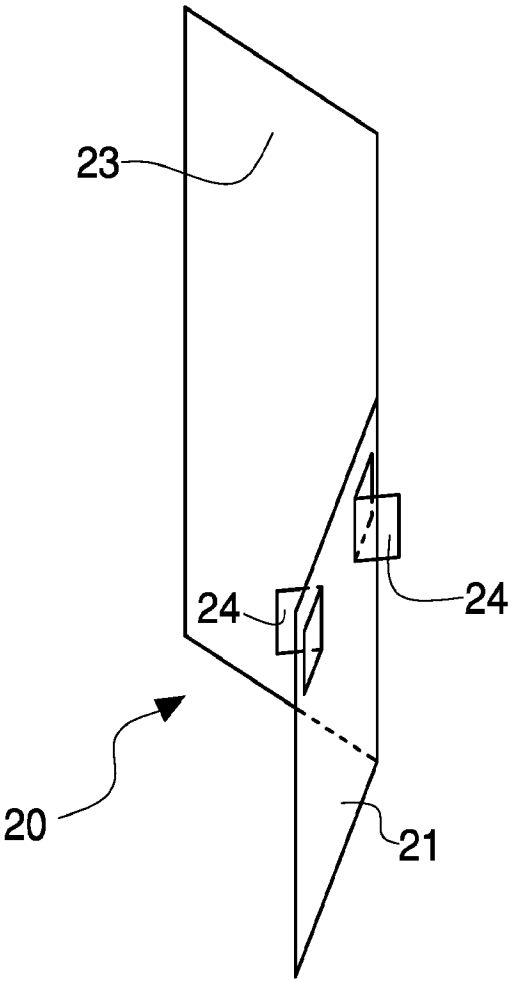
FIG. 9 is a schematic perspective view of the separating element of FIG. 8.

In FIGS. 8 to 9 a version is shown of the separating element 20 disclosed previously with reference to FIG. 7. In this version, the separating element 20 comprises two projecting elements 24 obtained on the separating wall 21. The projecting elements 24 are configured for each interacting with a tangential portion of a cigarette and project on opposite sides of the separating wall 21 inside the wrapper 3 so as to vary the available inner volume thereof.

A further function of the separating element 20 is to stabilise the two groups of cigarettes i.e. to avoid empty spaces inside the inner wrapper 3 and thus prevent the cigarettes tottering inside the inner wrapper 3; in fact, if the cigarettes were free to move inside the inner wrapper 3, the uncontrolled movements of the cigarettes during handling (both during the step of packaging the packet 1, and during the distributing and sales step) would subject the cigarettes to mechanical stresses that could cause an undesired emptying of the tips (i.e. the loss of fibres of tobacco from the free ends of the cigarettes).

The projecting elements 24 can be made by notching, punching or drawing the separating element 20.

According to a further embodiment that is not illustrated, the projecting elements 24 are obtained on the separating wall 21 and/or on the fixing wall 23.

Figure 10:
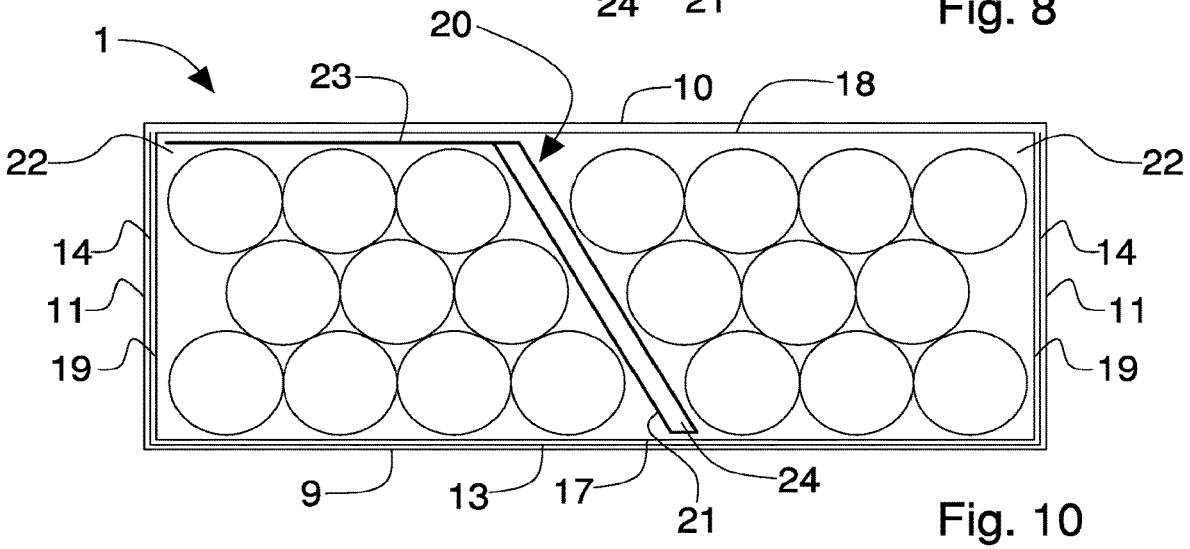
FIG. 10 is a cross section of the packet of cigarettes of FIG. 1 including yet another embodiment of the separating element.
Figure 11:
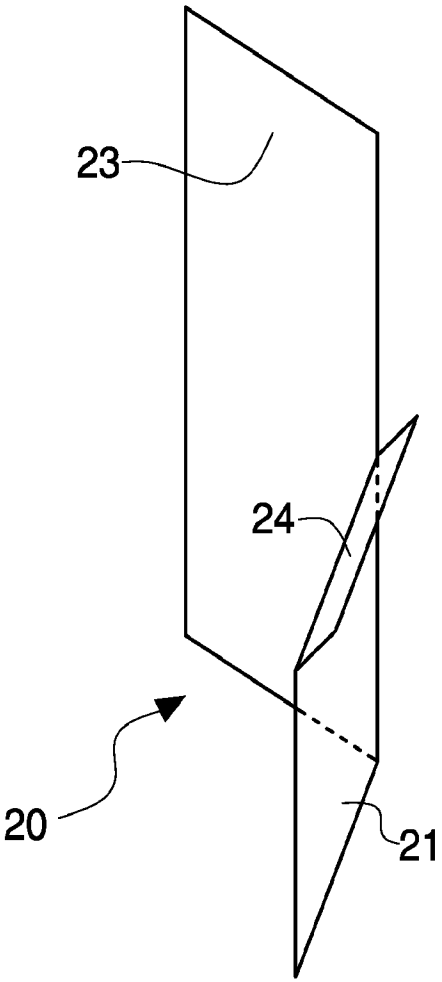
FIG. 11 is a schematic perspective view of the separating element of FIG. 10.

In FIGS. 10 and 11 a version is shown of the separating element 20 disclosed previously with reference to FIG. 7. In this version, the separating element 20 comprises a projecting element 24 obtained on the separating wall 21. The projecting element 24 is configured for interacting with tangential portions of several cigarettes and projects inside the wrapper 3 so as to vary the available inner volume thereof.

The projecting element 24 is made by folding, possibly by up to 180°, an end portion of the separating wall 21.

According to a further embodiment that is not illustrated, the projecting element 24 is obtained on the separating wall 21 and/or on the fixing wall 23.

According to another embodiment that is not illustrated, the separating element 20 comprises projecting elements 24 both of the type illustrated in FIGS. 8 and 9 and of the type illustrated in FIGS. 10 and 11, obtained on the separating wall 21 and/or on the fixing wall 23.

Figure 12:
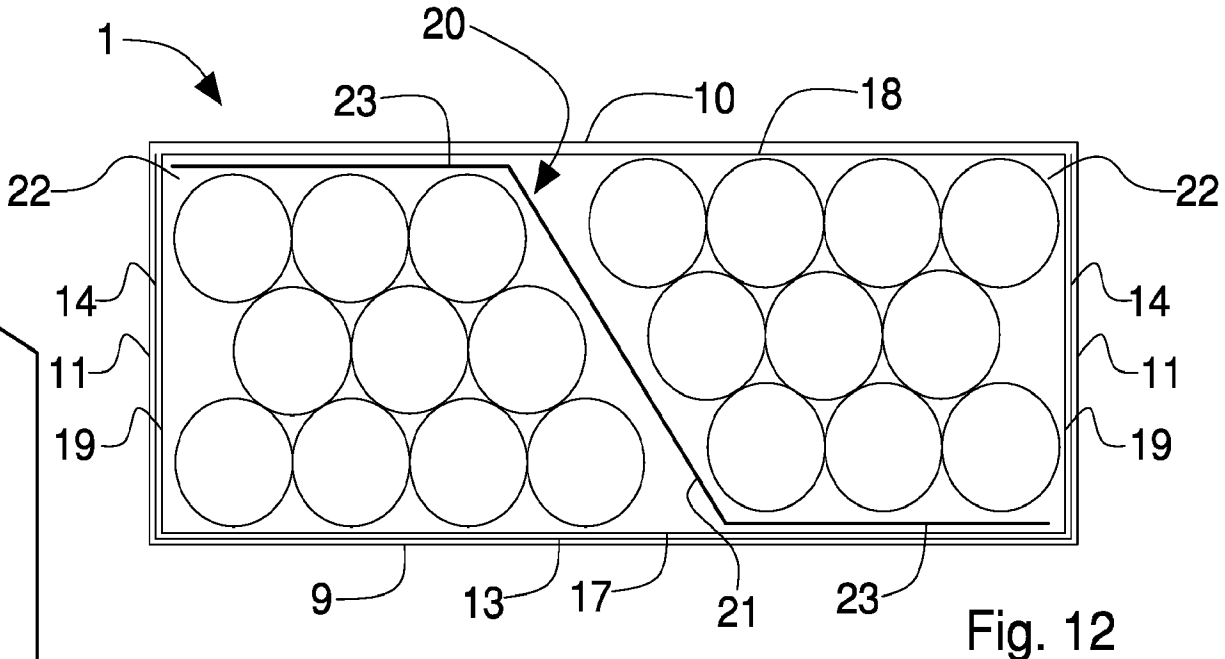
FIG. 12 is a cross section of the packet of cigarettes of FIG. 1 including another different embodiment of the separating element.

In the embodiment illustrated in FIG. 12, the separating element 20 comprises a separating wall 21 that extends parallel to a longitudinal axis of the cigarettes, is arranged transversely to the front wall 17 and rear wall 18 of the inner wrapper 3, and extends substantially over the entire distance that separates the rear wall 18 and the front wall 17 of the inner wrapper 3. According to a further embodiment that is not illustrated, the separating wall 21 extends parallel to a longitudinal axis of the cigarettes and is arranged perpendicularly to the front wall 17 and rear wall 18 of the inner wrapper 3.

The separating wall 21 separates the inner volume of the inner wrapper 3 into two chambers 22 each arranged for housing a sub-group of cigarettes formed by an identical number of cigarettes, in particular by ten cigarettes.

In the embodiment illustrated in FIG. 12, the separating element 20 further comprises two fixing walls 23 that are arranged at opposite ends of the separating wall 21 and connected to the latter by respective folding lines. The fixing walls 23 rest respectively on the front wall 17 and on the rear wall 18 of the inner wrapper 3. The fixing walls 23 are glued to the front wall 17 and to the rear wall 18 of the inner wrapper 3. According to a further embodiment that is not illustrated, only one of the fixing walls 23 is glued to the front wall 17, or to the rear wall 18, of the inner wrapper 3.

According to an embodiment, the separating wall 21 has a longitudinal dimension that is the same as the longitudinal dimension of the fixing wall 23 resting on the front wall 17 of the inner wrapper 3, and less than the longitudinal dimension of the fixing wall 23 resting on the rear wall 18 of the inner wrapper 3, the separating wall 21 ending lower than the inner frame 12.

In the embodiment illustrated in FIGS. 13 to 16, the separating element 20 comprises a separating wall 21 that extends parallel to a longitudinal axis of the cigarettes, is arranged transversely to the front wall 17 and rear wall 18 of the inner wrapper 3, and extends substantially over the entire distance that separates the rear wall 18 and the front wall 17 of the inner wrapper 3.

According to a further embodiment that is not illustrated, the separating wall 21 extends parallel to a longitudinal axis of the cigarettes and is arranged perpendicularly to the front wall 17 and rear wall 18 of the inner wrapper 3.

The separating wall 21 separates the inner volume of the inner wrapper 3 into two chambers 22 each arranged for housing a sub-group of cigarettes formed by an identical number of cigarettes, in particular by ten cigarettes.

In the embodiment illustrated in FIGS. 13 to 16, the separating wall 21 is formed by a first panel 25 and by a second panel 26 facing one another and connected by a folding line, and the separating element 20 comprises two fixing walls 23 connected by respective folding lines to the first panel 25 and to the second panel 26. Both the fixing walls 23 rest on the rear wall 18 of the inner wrapper 3, and at least one of the fixing walls 23 is glued to the rear wall 18 of the inner wrapper 3.

According to an embodiment, the fixing walls 23 have a different transverse dimension and the same longitudinal dimension, the latter being greater than the longitudinal dimension of the separating wall 21 which terminates lower than the inner frame 12.

According to an embodiment, the first panel 25 and the second panel 26 are glued together.

Figure 15:
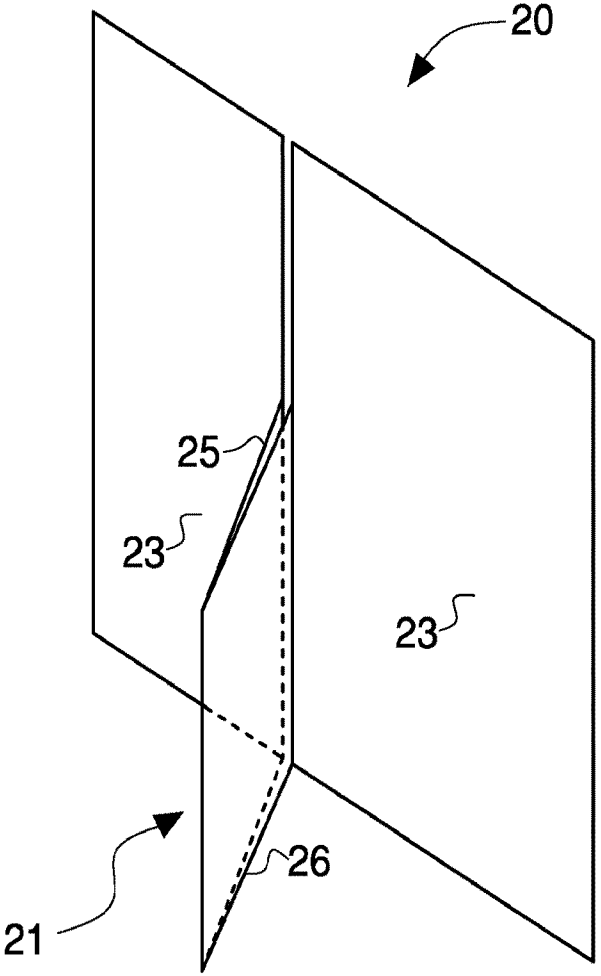
FIG. 15 is a schematic perspective view of a separating element of the packet of cigarettes of FIG. 13.
Figure 17:
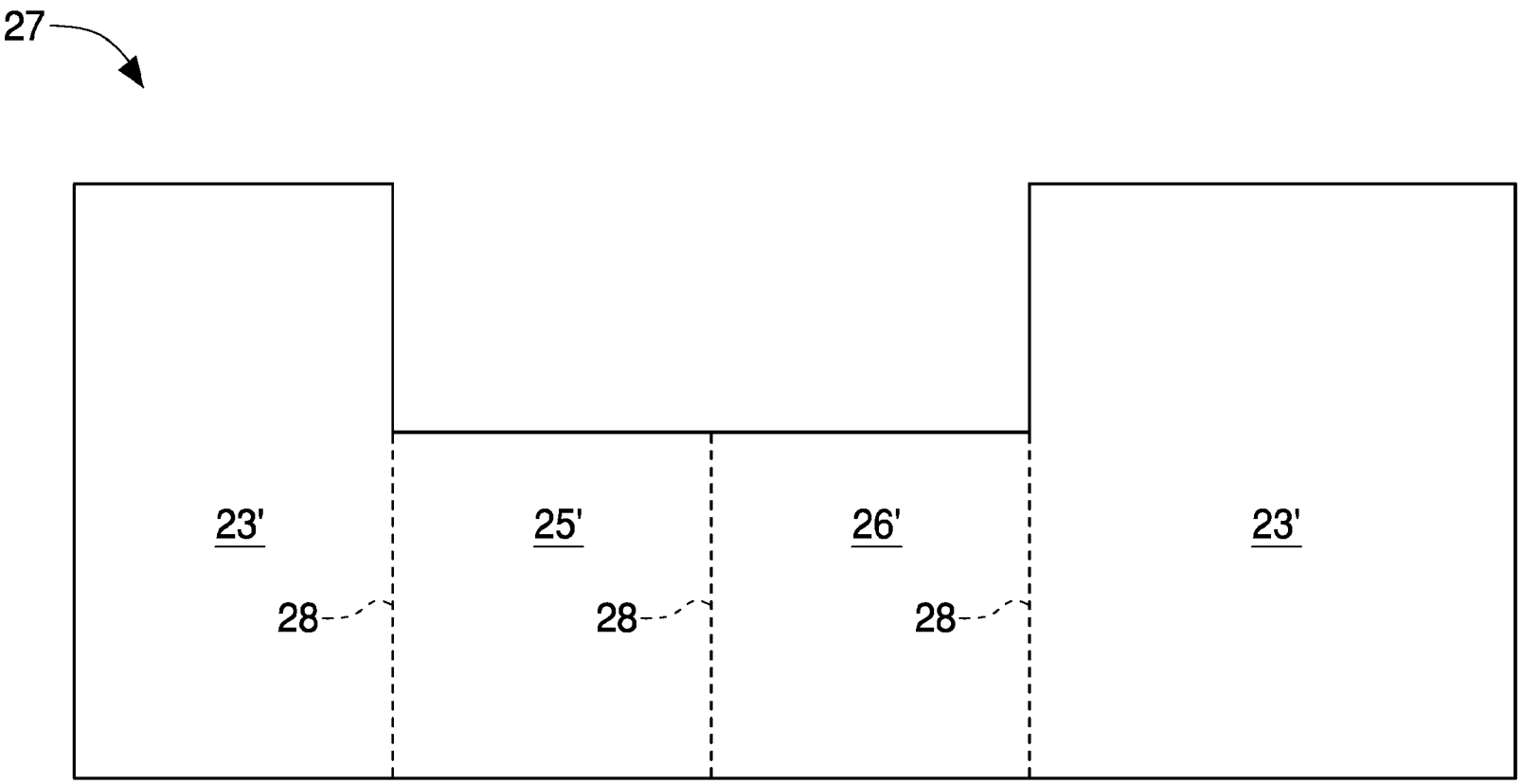
FIG. 17 is a plan view of a blank used for making the separating element of FIG. 15.

According to what is illustrated in FIG. 17, the separating element 20 illustrated in FIG. 15 is obtained from a flat blank 27 that is shaped for being cuttable by a continuous web of wrapper material.

In the following description, the parts of the blank 27 will be indicated, if possible, with accented reference numbers that are the same as the reference numbers that indicate the corresponding parts of the separating element 20 illustrated in FIG. 15.

The blank 27 has a substantially rectangular shape and has three longitudinal weakening lines 28, which are parallel to one another, which define first panels 25', 26' constituting the first panel 25 and the second panel 26 of the separating wall 21, and second panels 23' constituting the fixing walls 23.

Figure 20:
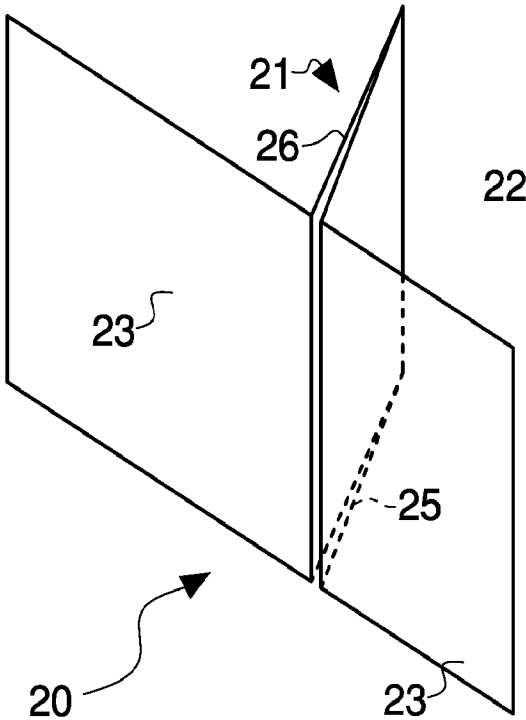
FIG. 20 is a schematic perspective view of a separating element of the packet of cigarettes of FIG. 18.
Figure 14:
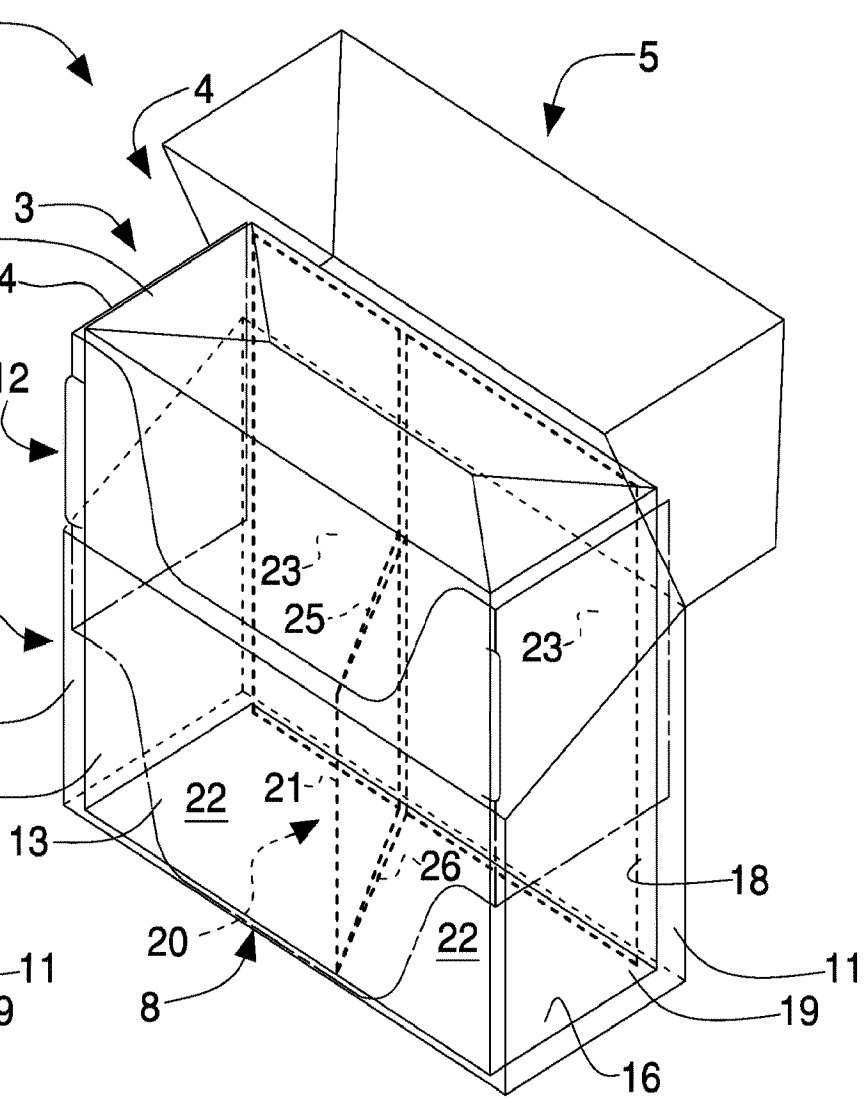
FIG. 14 is a front schematic perspective view of the packet of cigarettes of FIG. 13 in an open configuration and with the group of cigarettes removed from the inner wrapper.
Figure 13:
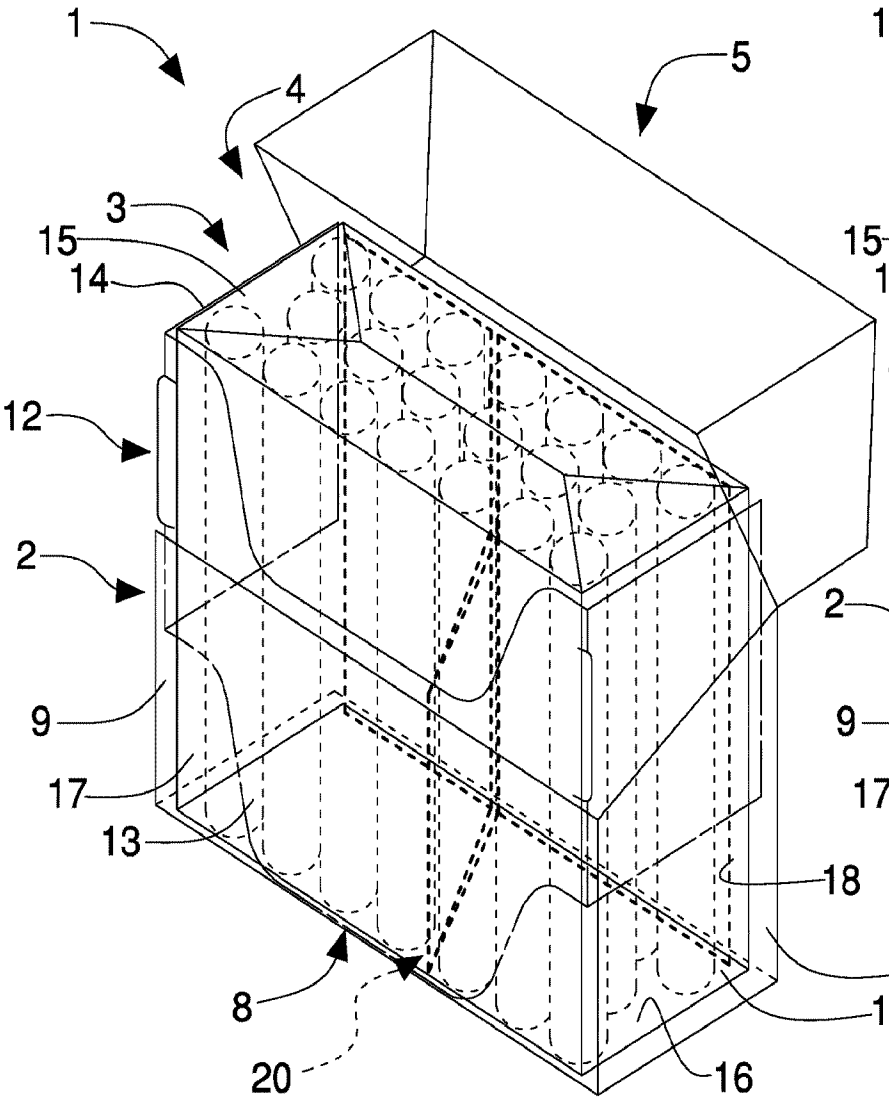
FIG. 13 is a front schematic perspective view of a rigid packet of cigarettes in an open configuration comprising a different embodiment of the separating element.
Figure 16:
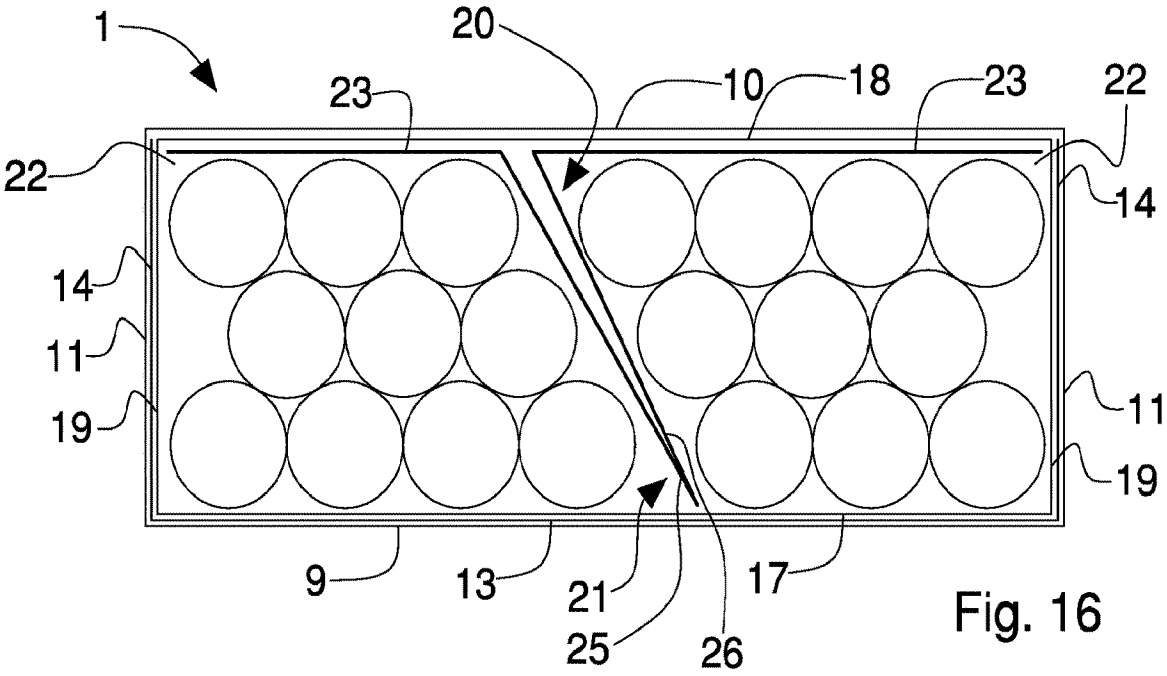
FIG. 16 is a cross section of the packet of cigarettes of FIG. 13.
Figure 19:
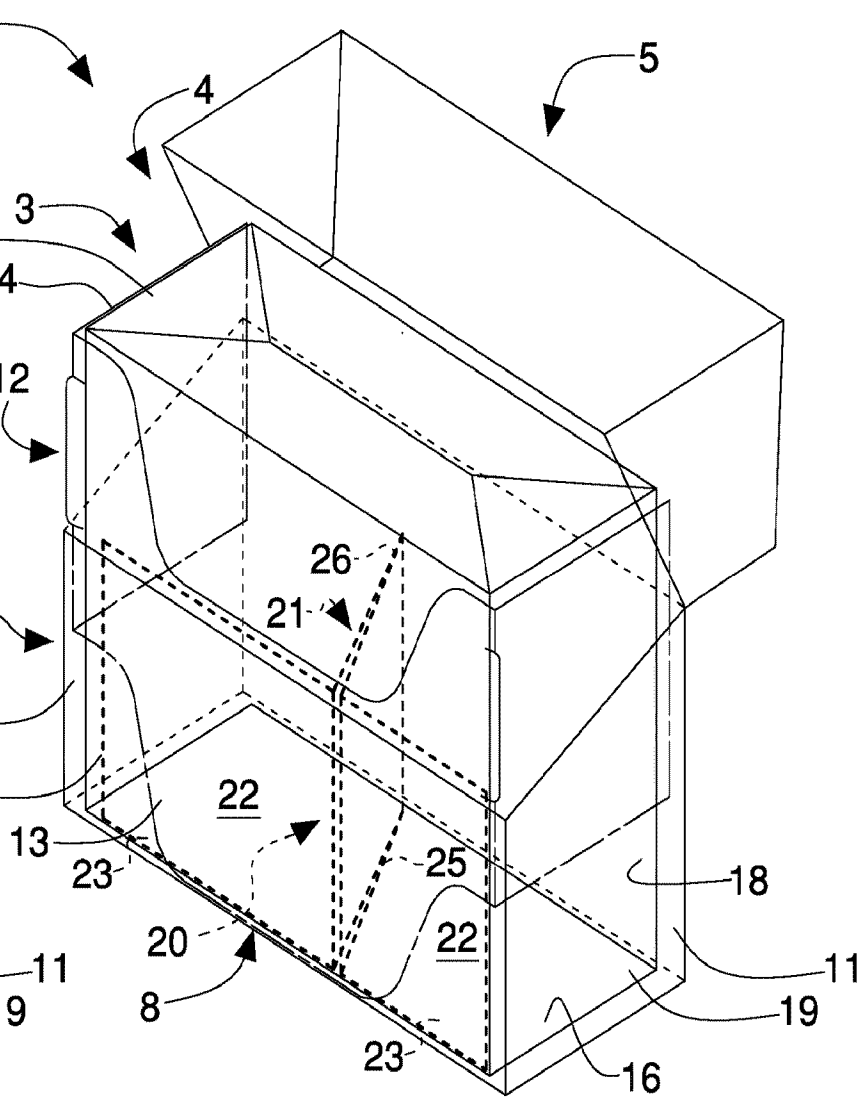
FIG. 19 is a front schematic perspective view of the packet of cigarettes of FIG. 18 in an open configuration and with the group of cigarettes removed from the inner wrapper.
Figure 18:
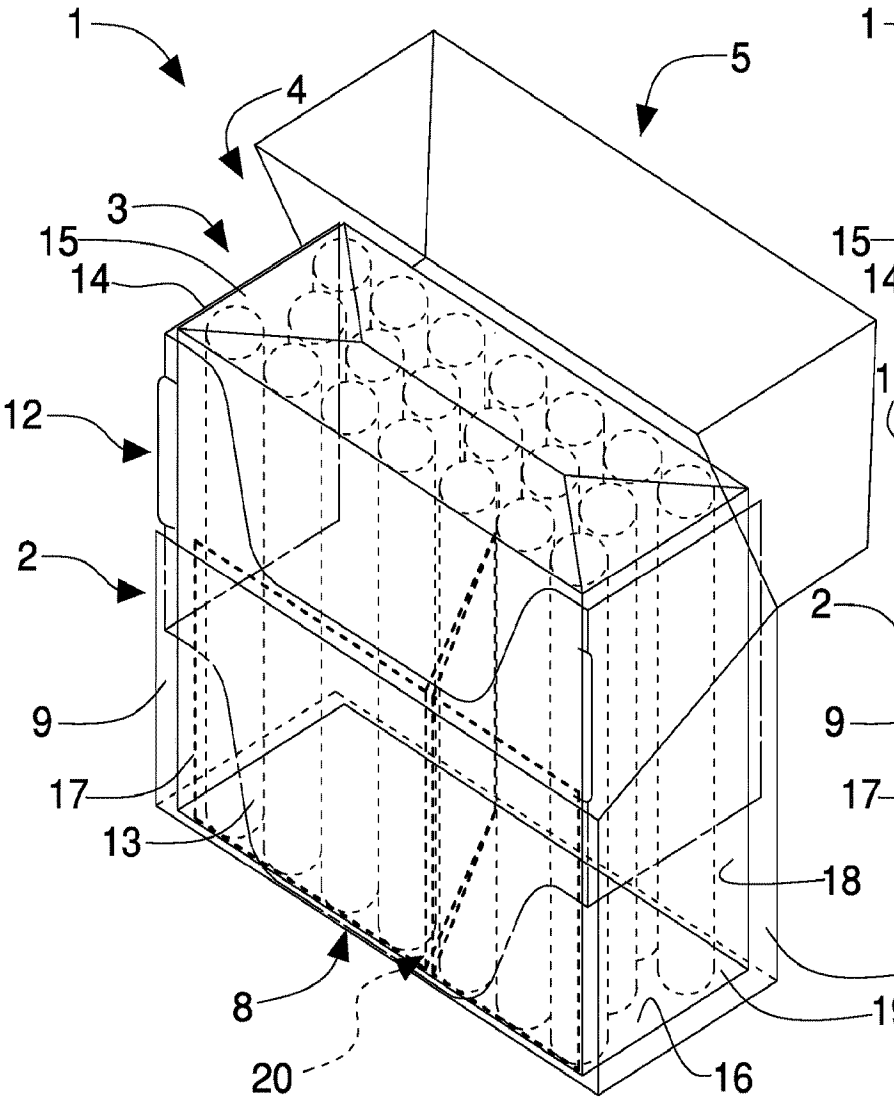
FIG. 18 is a front schematic perspective view of a rigid packet of cigarettes in an open configuration comprising another different embodiment of the separating element.

In the embodiment illustrated in FIGS. 18 to 20, the separating element 20 comprises a separating wall 21 that extends parallel to a longitudinal axis of the cigarettes, is arranged transversely to the front wall 17 and rear wall 18 of the inner wrapper 3, and extends substantially over the entire distance that separates the rear wall 18 and the front wall 17 of the inner wrapper 3.

According to a further embodiment that is not illustrated, the separating wall 21 extends parallel to a longitudinal axis of the cigarettes and is arranged perpendicularly to the front wall 17 and rear wall 18 of the inner wrapper 3.

The separating wall 21 separates the inner volume of the inner wrapper 3 into two chambers 22 each arranged for housing a sub-group of cigarettes formed by an identical number of cigarettes, in particular by ten cigarettes.

In the embodiment illustrated in FIGS. 18 to 20, the separating wall 21 is formed by a first panel 25 and by a second panel 26 facing one another and connected by a folding line and the separating element 20 comprises two fixing walls 23 connected by respective folding lines to the first panel 25 and to the second panel 26. Both the fixing walls 23 rest on the front wall 17 of the inner wrapper 3, and at least one of the fixing walls 23 is glued to the front wall 17 of the inner wrapper 3.

According to an embodiment, the fixing walls 23 and the separating wall 21 have the same longitudinal dimension, the separating wall 21 ending lower than the inner frame 12.

According to an embodiment, the first panel 25 and the second panel 26 are glued together.

Figure 21:
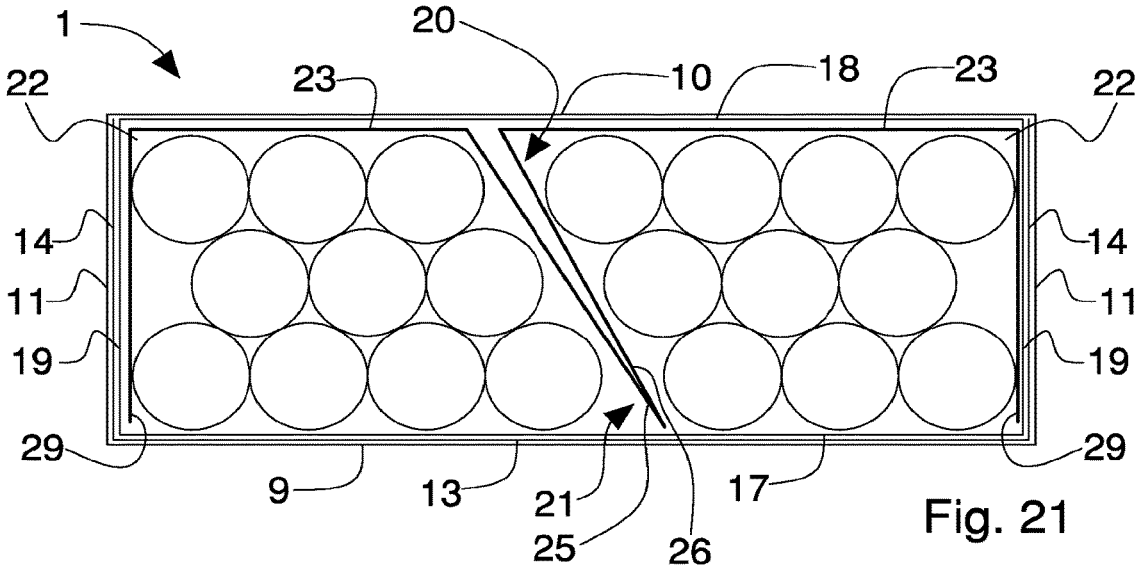
FIGS. 21 to 24 are cross sections of the packet of cigarettes of FIG. 1 including other embodiments of the separating element.

The embodiment illustrated in FIG. 21 differs from the embodiment illustrated in FIGS. 13 to 16 by the fact that the separating element 20 comprises two lateral walls 29 each resting on a respective lateral wall 19 of the inner wrapper 3 and connected, by a folding line, to a fixing wall 23. In the embodiment illustrated in FIG. 21 at least one of the lateral walls 29 of the separating element 20 is glued to a respective lateral wall 19 of the inner wrapper 3.

According to one embodiment that is not illustrated, the fixing walls 23 both rest on the front wall 17 of the inner wrapper 3, and at least one of the fixing walls 23 is glued to the front wall 17 of the inner wrapper 3.

Figure 22:
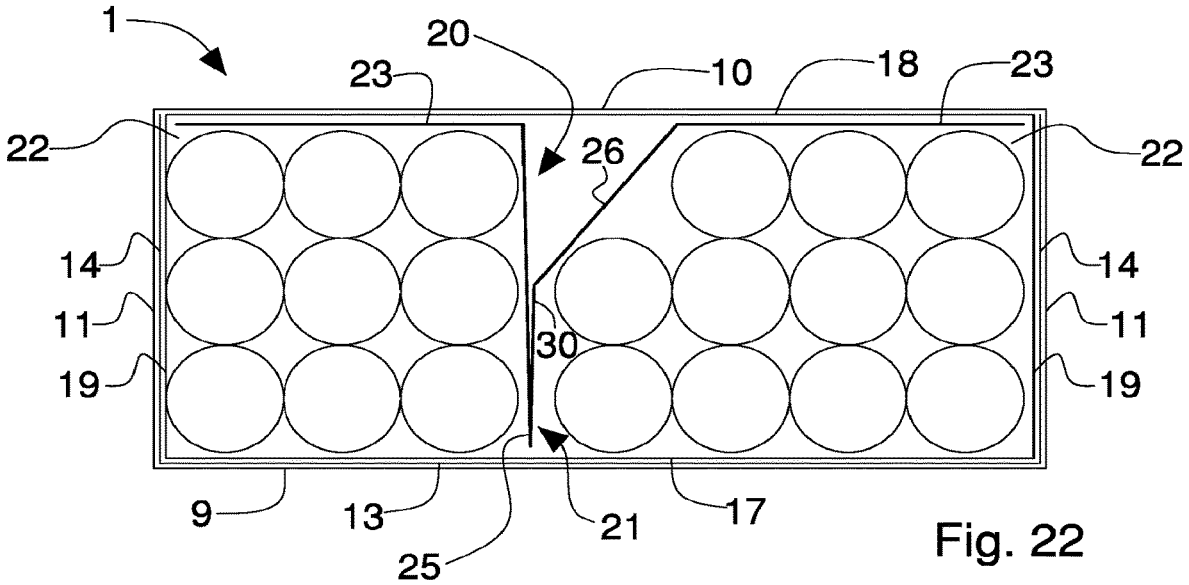

In the embodiment illustrated in FIG. 22, the separating element 20 comprises a separating wall 21 that extends parallel to a longitudinal axis of the cigarettes, is arranged transversely to the front wall 17 and rear wall 18 of the inner wrapper 3, and extends substantially over the entire distance that separates the rear wall 18 and the front wall 17 of the inner wrapper 3. The separating wall 21 separates the inner volume of the inner wrapper 3 into two chambers 22, one arranged for housing a sub-group of cigarettes formed by nine cigarettes and the other arranged for housing a sub-group of cigarettes formed by eleven cigarettes.

In the embodiment illustrated in FIG. 22, the separating wall 21 is formed by a first panel 25, by a second panel 26, and by a third panel 30 which are connected together by respective folding lines. The third panel 30 is interposed between the first panel 25 and the second panel 26. Also, the first panel 25 and the third panel 30 face one another whereas the second panel 26 is arranged transversely to the third panel 30. The separating element 20 comprises two fixing walls 23 connected by respective folding lines to the first panel 25 and to the second panel 26. Both the fixing walls 23 rest on the rear wall 18 of the inner wrapper 3, and at least one of the fixing walls 23 is glued to the rear wall 18 of the inner wrapper 3. According to an embodiment, the fixing walls 23 have the same longitudinal dimension, the latter being greater than the longitudinal dimension of the separating wall 21 which ends lower than the inner frame 12.

According to a further embodiment that is not illustrated, both the fixing walls 23 rest on the front wall 17 of the inner wrapper 3, and at least one of the fixing walls 23 is glued to the front wall 17 of the inner wrapper 3. According to this embodiment, the fixing walls 23 and the separating wall 21 have the same longitudinal dimension, the separating wall 21 ending lower than the inner frame 12.

According to an embodiment, the first panel 25 and the second panel 26 are glued together.

Figure 23:
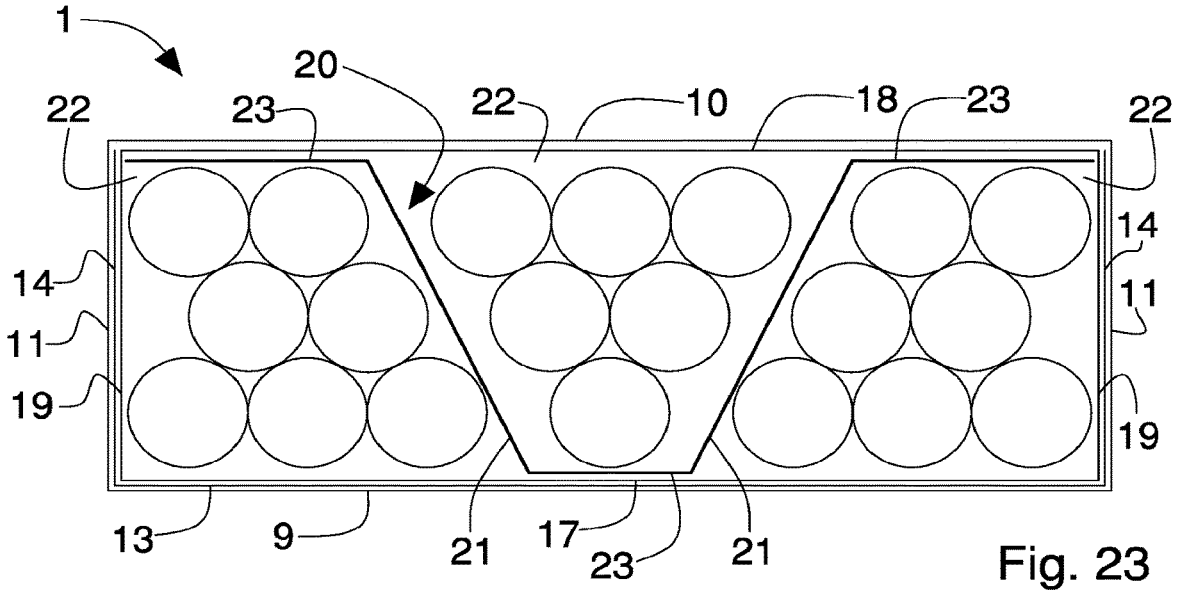

In the embodiment illustrated in FIG. 23, the separating element 20 comprises two separating walls 21 that extend parallel to a longitudinal axis of the cigarettes, are arranged transversely to the front wall 17 and rear wall 18 of the inner wrapper 3, and extend substantially over the entire distance that separates the rear wall 18 and the front wall 17 of the inner wrapper 3.

According to a further embodiment that is not illustrated, the separating walls 21 extend parallel to a longitudinal axis of the cigarettes and are arranged perpendicularly to the front wall 17 and rear wall 18 of the inner wrapper 3.

In the example shown, the separating walls 21 separate the inner volume of the inner wrapper 3 into three chambers 22, a central chamber arranged for housing a sub-group of cigarettes formed by six cigarettes and two lateral chambers that are each arranged for housing a sub-group of cigarettes formed by seven cigarettes.

The separating element 20 comprises three fixing walls 23, one fixing wall 23 being connected by a folding line to a first separating wall 21, another fixing wall 23 being interposed between and connecting by respective folding lines the separating walls 21, and the last fixing wall 23 being connected by a folding line to a second separating wall 21. The fixing wall 23 interposed between and connecting the separating walls 21 rests on the front wall 17 of the inner wrapper 3, whereas the remaining fixing walls 23 rest on the rear wall 18 of the inner wrapper 3. At least one of the fixing walls 23 is glued to the front wall 17, or to the rear wall 18, of the inner wrapper 3.

According to an embodiment, the fixing wall 23 interposed between the separating walls 21 has the same longitudinal dimension as the separating walls 21, whereas the remaining fixing walls 23 have a greater longitudinal dimension than the separating walls 21, the separating walls 21 ending lower than the inner frame 12.

According to a further embodiment that is not illustrated, the fixing wall 23 interposed between and connecting the separating walls 21 rests on the rear wall 18 of the inner wrapper 3, whereas the remaining fixing walls 23 rest on the front wall 17 of the inner wrapper 3. At least one of the fixing walls 23 is glued to the front wall 17, or to the rear wall 18, of the inner wrapper 3. According to this embodiment, the fixing wall 23 interposed between the separating walls 21 has a greater longitudinal dimension than that of the separating walls 21, whereas the remaining fixing walls 23 have the same longitudinal dimension as that of the separating walls 21, the separating walls 21 ending lower than the inner frame 12.

Figure 24:
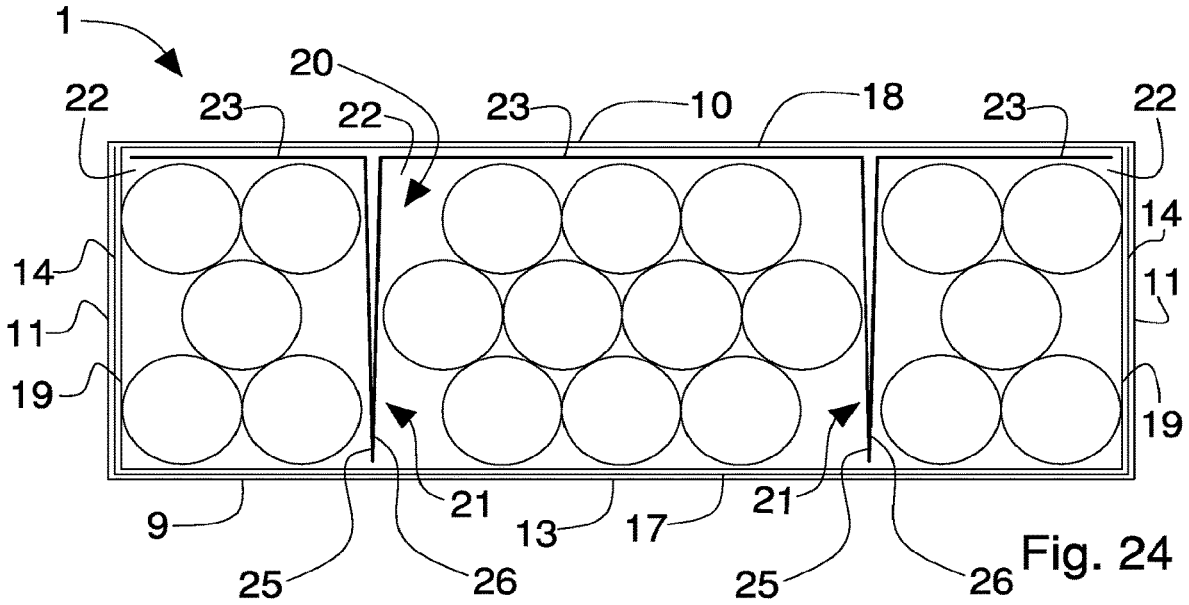

In the embodiment illustrated in FIG. 24, the separating element 20 comprises two separating walls 21 that extend parallel to a longitudinal axis of the cigarettes, are arranged perpendicularly to the front wall 17 and rear wall 18 of the inner wrapper 3, and extend substantially over the entire distance that separates the rear wall 18 and the front wall 17 of the inner wrapper 3.

According to a further embodiment that is not illustrated, the separating walls 21 extend parallel to a longitudinal axis of the cigarettes and are arranged transversely to the front wall 17 and rear wall 18 of the inner wrapper 3.

In the example shown, the separating walls 21 separate the inner volume of the inner wrapper 3 into three chambers 22, a central chamber arranged for housing a sub-group of cigarettes formed by ten cigarettes and two lateral chambers that are each arranged for housing a sub-group of cigarettes formed by five cigarettes.

In the embodiment illustrated in FIG. 24, the separating walls 21 are each formed by a first panel 25 and by a second panel 26 facing one another and connected by a folding line. According to an embodiment, the first panel 25 and the second panel 26 are glued together.

In the embodiment illustrated in FIG. 24, the separating element 20 comprises three fixing walls 23, one fixing wall 23 being connected by a folding line to a first panel 25 of a separating wall 21, another fixing wall 23 being interposed between and connecting by respective folding lines a second panel 26 of a separating wall 21 to a first panel 25 of another separating wall 21, and the last fixing wall 23 being connected by a folding line to the second panel 26 of the other separating wall 21. The fixing walls 23 rest on the rear wall 18 of the inner wrapper 3 and at least one of the fixing walls 23 is glued to the rear wall 18.

According to an embodiment, the fixing walls 23 have a greater longitudinal dimension than that of the separating walls 21, the separating walls 21 ending lower than the inner frame 12.

According to a further embodiment that is not illustrated, the fixing walls 23 rest on the front wall 17 of the inner wrapper 3 and at least one of the fixing walls 23 is glued to the front wall 17. In this embodiment, the fixing walls 23 have a longitudinal dimension that is the same as that of the separating walls 21, the separating walls 21 ending lower than the inner frame 12.

It should be noted that also in the embodiments illustrated with reference to FIGS. 3 to 6, and 12 to 24, including variations, one or more of the projecting elements 24 disclosed above may be present.

Also, it should be noted that the lateral walls 29 disclosed with reference to the embodiment illustrated in FIG. 21 can also be present in the other embodiments.

Also, it should be noted that the separating element 20 can be used instead of the inner frame 12 in the case of sealed packets, in which the inner wrapper 3 consists of a sheet of heat sealable material, i.e. of a sheet of thermoplastic multilayered material (impermeable barrier) and in which a repositionable adhesive label is present or a liftable and reclosable flap that are part of the material of the multilayered sheet that covers an extracting opening of the cigarettes. In such packets, the separating element 20 also acts as an abutment for the repositionable label and is shaped in such a manner as to enable easy access to the cigarettes.

The packet 1 of cigarettes disclosed above has numerous advantages.

Firstly, the packet 1 of cigarettes disclosed above is easier to produce than known packets. If fact, the packet 1 of cigarettes can also be produced in a suitably modified existing packaging machine. The separating element 20 can be obtained from a continuous web of wrapper material with processes similar to those used to make the inner frame 12; thus handling of the separating element 20 is simple (using only known technologies and components) and takes up little space.

Also, the separating element 20 is made as a single body, by folding a cardboard, this making the separating element 20 easy and fast to produce and low cost.

Further, the separating element 20 is fixed, by gluing, to an inner surface of the inner wrapper 3, in this manner making the separating element 20 particularly stable and difficult to remove from the container 2, even with intensive use of the packet 1.

Also, the projecting elements 24 make the packet 1 more flexible than known packets because they enable cigarettes to be housed in the inner wrapper 3 that have different cross sections, i.e. diameters, in particular the so-called "slim" cigarettes with reduced diameter.

Further, chambers 22 that have a cross section that is less than the longitudinal dimension of the cigarettes prevent the cigarettes from falling and getting stuck on the bottom of the packet 1, also making the extraction of the last cigarettes easy.

Also, the separating element 20 provides suitable longitudinal support to the cigarettes, at the same time making the packet 1 more rigid, thus preventing damage to the cigarettes following the collapse of the packet 1 due to use.

Lastly, it should be noted how, owing to the lateral walls 29 of the separating element 20, it is possible to stiffen further the packet 1 and provide an abutment during heat sealing of the inner wrapper 3 around the group of cigarettes.

What is claimed is:

1. A packet of smoke articles, comprising:

a container, which has a parallelepiped shape and has a front wall, a rear wall, a bottom wall and two lateral walls;

a parallelepiped-shape inner wrapper that wraps a group of smoke articles, which is housed inside the container and has a front wall, a rear wall, a top wall, a bottom wall and two lateral walls; and a separating element, which is arranged inside the inner wrapper and divides an inner volume of the inner wrapper so as to form several partitions of the group of smoke articles, the separating element extends parallel to a longitudinal axis of the packet and is arranged oblique to the front wall and rear wall of the inner wrapper;

wherein the separating element is a single separating wall, the separating wall separates the inner volume of the inner wrapper into two chambers each containing a respective partition of the group of smoke articles;

wherein the separating wall has only one longitudinal edge that rests on and is fixed to one of the front wall or the rear wall of the inner wrapper, wherein an adhesive is disposed on the longitudinal edge for fixing the separating wall to the inner wrapper;

wherein the separating wall constitutes a border between the two chambers.

2. The packet of smoke articles according to claim 1, wherein the separating element is made as a single body.

3. The packet of smoke articles according to claim 1, wherein the separating wall extends at least a distance that separates the rear wall and the front wall of the inner wrapper.

4. The packet of smoke articles according to claim 1, further comprising:

a lid configured to close an open top end of the container;

a hinge connecting the lid to the container; and an inner frame being arranged inside the container, the inner frame comprising a front wall which is arranged in contact with the front wall of the container, and the inner frame comprising two lateral walls which are arranged on opposite sides of the front wall of the inner frame and are arranged in contact with the lateral walls of the container.

5. The packet of smoke articles according to claim 4, wherein the inner frame projects partially outside the open top end of the container.

6. The packet of smoke articles according to claim 5, wherein a distance between a top edge of the separating wall of the separating element and the bottom wall of the container is less than a distance between a top edge of the front wall of the inner frame and the bottom wall of the container.

7. The packet of smoke articles according to claim 4, wherein the front wall of the inner frame is attached to the front wall of the container.

8. The packet of smoke articles according to claim 4, wherein the lateral walls of the inner frame are attached to the lateral walls of the container.

9. The packet of smoke articles according to claim 1, wherein the inner wrapper is a sheet of metal foil.

10. The packet of smoke articles according to claim 1, wherein the single longitudinal edge of the separating wall is fixed to said one of the front wall or the rear wall of the inner wrapper with an adhesive strip.

11. The packet of smoke articles according to claim 1, wherein the separating element is made of cardboard.

12. The packet of smoke articles according to claim 1, wherein the separating wall comprises another longitudinal edge that is opposite the single longitudinal edge and that is arranged freely.

* * * * *